United States Patent [19]

Lefevre

[11] 4,213,833

[45] Jul. 22, 1980

[54] ELECTROLYTIC OXIDATION IN A CELL HAVING A SEPARATOR SUPPORT

[75] Inventor: Joseph D. Lefevre, Bay City, Mich.

[73] Assignee: The Dow Chemical Company, Midland, Mich.

[21] Appl. No.: 939,602

[22] Filed: Sep. 5, 1978

[51] Int. Cl.[2] ..... C25B 1/16; C25B 1/26; C25B 9/04; C25B 13/04

[52] U.S. Cl. ..... 204/98; 204/128; 204/258; 204/277; 204/278; 204/295; 204/296

[58] Field of Search ..... 204/98, 128, 295, 296, 204/258, 277–278

[56] References Cited

U.S. PATENT DOCUMENTS

| | | | |
|---|---|---|---|
| 1,378,829 | 5/1921 | Riiber | 204/295 |
| 3,905,879 | 9/1975 | Eng et al. | 204/296 |
| 4,035,255 | 7/1977 | Gritzner | 204/98 |

*Primary Examiner*—R. L. Andrews
*Attorney, Agent, or Firm*—James H. Dickerson, Jr.

[57] ABSTRACT

The diaphragm or equivalent element in an electrolytic cell is disposed on and maintained by a foraminous metallic or other electroconductive support structure which is electrically connected to the cathode in the cell so that both the supported diaphragm or other separator unit structure and the cathode have the same potential thereby at least minimizing and frequently even avoiding bipolar effects during cell operation.

19 Claims, 2 Drawing Figures

ELECTROLYTIC OXIDATION IN A CELL HAVING A SEPARATOR SUPPORT

BACKGROUND OF THE INVENTION

The production of halogens from aqueous solutions (or other dispersions including even slurries) of their corresponding acids or alkali metal salts and the like by electrolysis thereof in electrolytic diaphragm or equivalent separator cells is well known and widely practiced. Improved techniques to accomplish such production include utilization of oxidizing gas depolarized cathodes in the involved halogen-manufacturing cell units. The manufacture of caustic soda and chlorine from common salt is a good illustration and a particularly important application of this type means for making halogens and associated co-products.

Various aspects relevant to the use of oxygen or oxygen depolarized cathodes in electrolytic cells are amply demonstrated in, inter alia, U.S. Patents and Patent Reference Nos. 1,474,594; 2,273,795; 2,681,884; 3,035,998; 3,117,034; 3,117,066; 3,262,868; 3,276,911; 3,316,167; 3,507,701; 3,544,378; 3,645,796; 3,660,255; 3,711,388; 3,767,542; 3,923,628; 3,926,769; 3,935,027; 3,959,112; 4,035,254; and 4,035,255, all herein incorporated by reference.

It has been observed, however, that in order to employ an oxygen or the like electrode as a depolarized cathode in a chlor-alkali or equivalent diaphragm or equivalent separator cell, it is advantageous for the separator element to be maintained and supported for operation so as to actually be spaced a short distance from the cathode in order to better accommodate gas transport to the cathode while maintaining the electrolyte solution on one side of the cathode and the gas on the other side. This is the case with asbestos diaphragms, ion exchange membranes or anything similar or analogous thereto. It is especially so when a drawn asbestos diaphragm is to be used which, for practical purposes, is better deployed when mounted on a rigid support. While metallic screens, grids or the like foraminous metal constructions are ostentatiously well suited for utilization as support elements or backing members for asbestos diaphragms, they are ordinarily not employed for the purpose. This is because of the disadvantageous fact that under normal operating conditions of a typical electrolytic diaphragm cell, a metallic diaphragm support element frequently and sometimes unpredictably tends, with most undesirable and unwanted results, to become and function as an electrode due to bipolar effects which arise and materially influence metallic support behavior.

The basic characteristics and operational principles and limitations of electrolytic diaphragm and ion exchange membrane cell practice are so widely comprehended by those skilled in the art that further elucidation thereof and elaboration thereon is unnecessary for thorough understanding and recognition of the advance contributed and made possible to achieve by and with the development(s) of the present invention.

FIELD AND OBJECTIVES OF THE INVENTION

The present invention pertains to and resides in the general field of electrochemistry and is more particularly applicable to an improved and at least substantially if not completely bipolarization-proof or non-bipolarizing, metallically supported separator for usage in electrolytic cells constituted with oxidizing gas depolarized cathodes, especially when utilized in and for halogen or halogen-alkali producing electrolysis units. The provision and use of such an advantageous and beneficial asbestos diaphragm and/or ion exchange membrane arrangement are amongst the principal aims and objectives of the invention.

SUMMARY OF THE INVENTION

As is evident herein, an improved separator element for more advantageous electrolytic cells has been developed. In accordance with the present invention, the electrolytic cell containing the improved separator element comprises an anode compartment adapted to contain an anolyte; an anode positioned in said anode compartment; a cathode compartment adapted to contain a catholyte; an oxygen-bearing gas depolarized cathode in said cathode compartment; a separator element which is spaced away from and intermediately located centrally in said cell between both said anode and said cathode, said anode compartment and said cathode compartment being juxtaposed and separated in said cell; said separator element having a suitable separator material section placed on at least one side of an electroconductive foraminous support member; there also being with the cell a source of and means for providing direct electrical current power connected to both said anode and said cathode so that a relatively higher voltage potential is therefrom applied to the anode; and electrical means for maintaining said electroconductive foraminous support element at about the same applied electrical voltage potential as that of said cathode.

The separator element may be comprised of a structure having two sides, one of which is a suitable separator material section which is deposited upon and substantially held by and to the foraminous support member as the other side of the element; said separator element being located in said cell when separator material is on only one side thereof so as to have said electroconductive support member side of the element facing said depolarized cathode.

The electrical means for maintaining the voltage applied to said electroconductive foraminous support element may be a separate power supply connected thereto that is adapted to maintain the element at about the same voltage potential as that of said cathode.

Beneficially and as a simplified embodiment thereof, the electrical means for maintaining the voltage applied to said electroconductive foraminous support member is a direct shorting electrical connection between said separator element and said depolarized cathode so as to maintain them at the same electrical potential during operation of said cell.

The foraminous support member for the separator is advantageously metallic in nature. The separator material employed can either be an ion exchange membrane or asbestos (or equivalent material) in a diaphragm form such as in drawn asbestos separator structures.

The improved separator element, per se, is within the purview of the invention; as is the method of operating the herein contemplated and disclosed electrolytic cell.

BRIEF DESCRIPTION OF THE DRAWINGS

Further features and characteristics of the non-bipolarizing, metallic (or otherwise electroconducting) supported separator element development in accordance with the present invention, and the way in which it so nicely achieves and fulfils the presently-intended aims and objectives and contributes to the art for which it is pertinent are more readily apparent and evident in the ensuing Specification and description, taken in conjunction with the accompanying Drawing, wherein (using like reference numerals for like parts).

PARTICULARIZED EXEMPLIFICATION OF THE INVENTION

Figure 1:
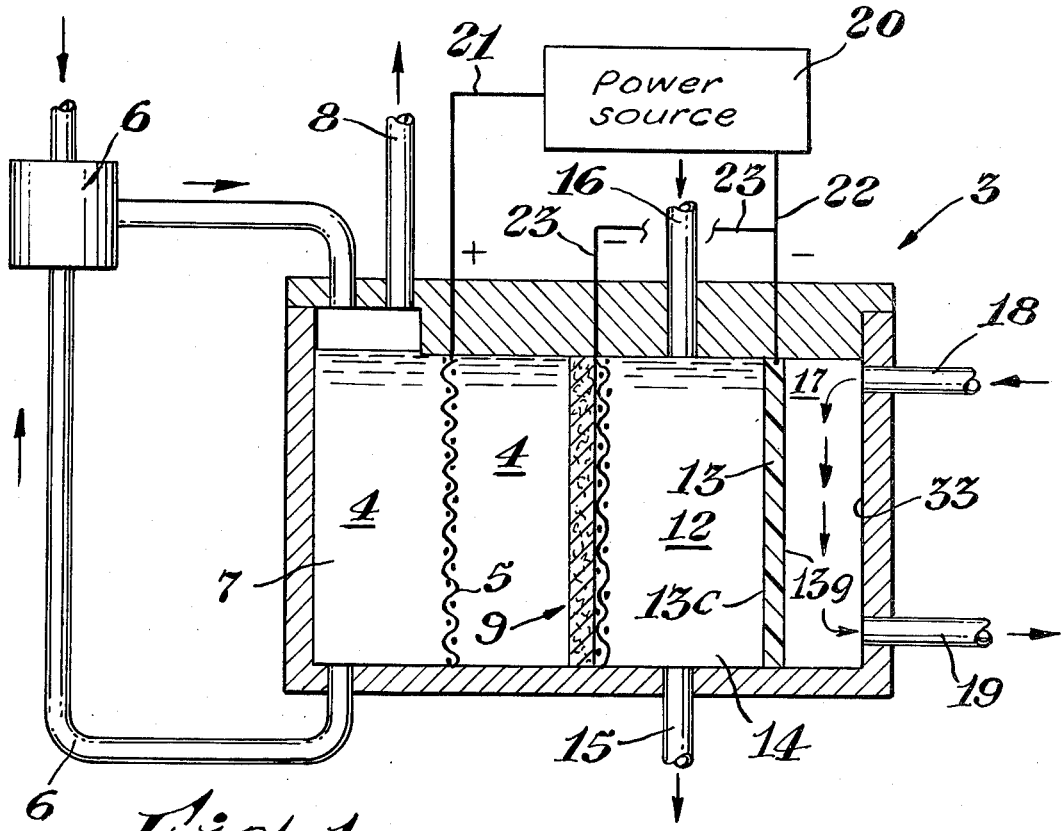
FIG. 1 is a schematic, largely-simplified, exaggerated elevational view, mostly in section, of a typical cell utilizing a non-bipolarizing asbestos-type diaphragm separator element pursuant to the invention.

With initial reference to FIG. 1 of the Drawing, there is shown an electrolytic cell, identified generally by the reference numeral 3, for the production of a halogen (such as chlorine) from a corresponding acid (such as hydrogen chloride) or alkali metal chloride (such as sodium chloride) or even in many situations where economically affordable for production of other end products from diverse acids and salts as from sulfates, nitrates and so forth. For purposes of immediate illustration, the cell 3 is pictured to be electrolyzing sodium chloride brine into chlorine and sodium hydroxide and to be provided with an asbestos diaphragm separator.

The cell 3 includes an anode compartment 4 with an anode 5, at which the oxidation reaction occurs, positioned therein. This is in spaced juxtaposition with a cathode compartment 12 having therein positioned a depolarized cathode 13, at which the reduction reaction occurs. A non-bipolarizable supported diaphragm or separator, identified generally by reference numeral 9, is centrally positioned in the cell to divide or separate anode compartment 4 from cathode compartment 12. The diaphragm separator element 9 is adapted to pass sodium ions from the anolyte solution 7 in anode compartment 4 to the catholyte solution 14 in cathode compartment 12. This is accomplished, for reasons and by means as above mentioned and hereinafter more fully explained, with the separator element 9 remaining at the same electrical potential as cathode 13 without undergoing deleterious bipolarization effects to an intolerable degree or extent, if any. Element 9, accordingly, is able to at least substantially, if not completely, withstand electrolysis system influences that tend to place it in an undesirable bipolarized condition.

Typically, cell 3 further includes a source of sodium chloride brine (not shown) and a means 6 to feed the brine into the anode compartment 4 and maintain the anolyte 7 at a predetermined and suitably operable sodium chloride concentration, as desired. Gaseous chlorine is removed from anode compartment 4 by any suitable means, such as conduit 8, which is connected in an appropriate venting communication with the compartment in order to safely and efficiently afford the desired withdrawal and recovery of the halogen product.

As shown (which is one of the ways known to make it), the depolarized cathode 13 is spaced apart from a side portion or wall 33 of the cell 3 to form an intermediate opening or gas compartment 17. An oxidizing gas, such as air, oxygen-enriched air, oxygen, ozone (or the like or equivalent) is forced through inlet tube 18 into, preferably, the upper portion of the compartment 17 and passed in intimate contact with an outer surface or face 13g of the cathode 13. The oxidizing gas, following the flow pattern through compartment 17 depicted by the directional arrows therein, is then withdrawn through outlet means 19 for disposal or recycle, depending upon the practice most expedient and preferred under the particular operating conditions being followed. Cathode 13, pursuant to known practice for cathodes depolarized with an optionally moisturized oxygen-bearing gas, is composed of a suitable material adapted to transmit or pass, with minimized or no bubble formation on egress, the given oxidizing gas from compartment 17 to an inner portion or surface 13c of the cathode.

Thus, cathode 13 is preferably an embodied foraminous construction having at least the surface thereof composed of a material that is substantially inert and resistant to the corrosive effects of the catholyte such as, for example, (but not limited to), gold, iridium, osmium, palladium, platinum, rhodium, ruthenium and silver (or compositions and platings thereof including, as an illustration, a suitable foraminous copper substrate that is silver plated) with an applied and integral coating thereover of a mixture of the particulate metallic constituent and an inert binder therefor such as polytetrafluorethylene, polyhexafluoropropylene and other polyhalogenated ethylene or propylene derivatives such as fluorinated copolymers of hexafluoropropylene and tetrafluorethylene, which coating mixture may advantageously contain between about 30 and about 70 weight percent carbon black with a mesh size of less than about 300 admixed with up to, say, 10 or so weight percent of carbon fibers.

These metallic materials, as is known, have a beneficial catalytic effect for reaction under the conditions of electrolysis in the presence of water of the $O_2$ in the oxygen-bearing gas at the surface of the depolarized cathode.

The inert material may be any one of the substances known as carbon black, nickel black, nickel oxide black, platinum black or silver black. The particulate material that is ordinarily designated as a "black" advantageously has a range of less than about 300 in the U.S. Standard mesh size series.

The actual base construction of the metal in the cathode may, for example, be in the form of a screen or an expanded metal section or an apertured or perforated sheet or equivalent grid-like structure having a thickness in the neighborhood of from about 10 to about 100 mils (ca. 0.254 and 2.54 millimeters) and a porosity or total hole or open area which is between about 20 and about 40 percent of the total area of that portion of the grid having the greatest exposed surface with the mean diameter (or equivalent measure of the openings each being between about 15 and about 30 mils—or ca. 0.381 and 0.762 millimeters). Plated layers, such as of silver on copper or a copper alloy, is desirably substantially if not completely continuous and in a thickness of about 2 mils (ca. 500+ microns).

It is usually beneficial to have the cathode 13 made up as a screen construction which is either entirely woven from or, alternatively, partially fabricated of and subsequently adherently plated or coated with metallic gold, platinum, nickel or silver with a mesh size of from about 30 to about 60 or, with advantage, about 50.

Nickel is frequently a preferred choice as the material of screen construction. Although usually not employed for depolarized cathodes, it is also possible to use a mild steel or other ferrous material or alloy including stainless steels for the grid-like cathode structure, especially when it is appropriately coated or plated with a suitable catalyzing substance of the sort above described.

The anode construction may be analogous to that employed for the cathode, excepting that for brine electrolysis it generally is not comprised of any ferrous materials. It can also be a carbon or graphite electrode body or, oftentimes with advantage, a structure of the type known in the art as a dimensionally stable anode comprised of base members of, for example, tantalum or titanium or tungsten or zirconium, or other electroconductive materials coated or plated with such metals, for example, as at least one metal or oxide of the platinum group metals or iridium, rhodium, ruthenium and so forth including other of the elements above-identified for constituting the inert anode surface.

It is also usually beneficial to utilize efficient circulating means (such as agitators, impellers, recirculatory pump installations, aerators or gas bubblers, ultrasonic vibrators and so forth, not shown) to continuously move the catholyte 14 and avoid stagnations thereof within the cathode compartment 12, primarily to promote thorough mixing of the catholyte formulation. The rate of such catholyte movement should be sufficient to ensure adequate repetitive and nearly if not completely total liquid contact of the cathode interface and yet not so intense as to cause any physical injury to or disruptment of the diaphragm element 9 or equivalent separator element.

During cell operation, the catholyte 14 becomes increasingly enriched in its concentration of sodium hydroxide. This co-product can be removed in regulated fashion to keep catholytic caustic content at a controlled, predetermined strength.

The electrical energy necessary to conduct the electrolysis in cell 3 is obtained from a power source 20 connected to energy transmission or carrying means such as aluminum (especially in corrosion-resisting adaptations), magnesium-filled titanium or copper conduits, bus bars or cables 21 and 22 to respectively provide direct electrical current to the anode 5 and cathode 13.

Figure 2:
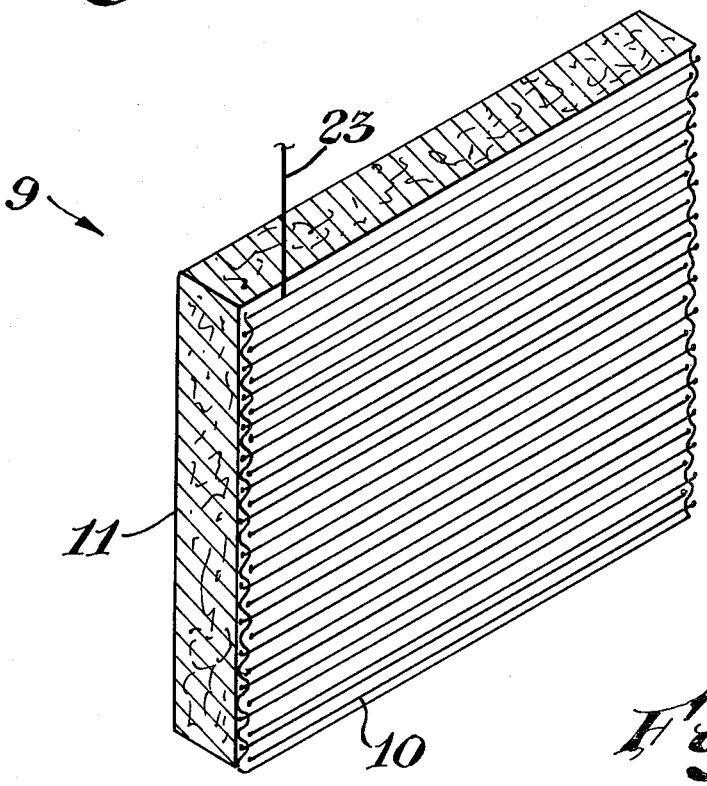
FIG. 2 is a view in fanciful, enlarged, cross-sectional perspective, of one embodiment of the diaphragm element, per se.

A non-bipolarizable diaphragm or separator element 9 that is particularly illustrated in FIG. 2 of the Drawing is comprised of a layer 11 of suitable asbestos-type diaphragm material which is disposed or placed upon and securely maintained by a metallic screen support or grid 10. As disclosed although not illustrated in the Drawing, the separator 9 can alternatively as desired and frequently with advantage be made up of a similarly supported ion-exchange membrane suitable for cell separator purposes which is placed upon and attached to screen 11. The support screen can be fabricated and composed of the same types of metal and plated metal construction as described in the foregoing in connection with the metallic materials for the cathode, with nickel oftentimes being quite desirable for the purpose. In any event, the screen material, for practical purposes, is at least somewhat relatively, if not completely, resistant to chemical attack by the catholyte.

This ordinarily and for the sake of minimized maintenance problems decreases the utility and practicality in the use of steel or other ferrous materials which may become disadvantageously and undesirably corroded due to catholyte attack when left to remain in the cathode during periods of shut down or non-electrolysis action. However, it is possible to satisfactorily employ even a mild steel screen support for the diaphragm element during cell operation of non-acid systems by virtue of the cathodic protection then afforded the screen member when the same is utilized in practice according to the present invention.

The separator screen support 10 can be sized somewhat similarly to the screens used for cathode construction, excepting that networks having relatively larger openings can be employed. In any event, the screen support has openings large enough to accomodate free flow of materials through the diaphragm or ion-exchange membrane separator element yet small enough for effective support of the applied diaphragm material. Thus, the networks used may have openings that are as big as $\frac{1}{4}\times\frac{1}{4}$ inch ($0.6\times0.6$ or so, centimeters) or, if desired, even as large as $\frac{1}{2}\times\frac{1}{2}$ inch ($1.3\times1.3$, or so, centimeters).

Although asbestos, per se, is frequently very advantageous to employ as the porous diaphragmic material in the supported layer 11 when an asbestos-type diaphragm separator is used, many other equivalent materials can be adapted for such purpose including, for example, mixtures of asbestos and fibrous polytetrafluoroethylene (e.g., sold under the tradename "Teflon") or fibers of other polymers and copolymers of fluorinated ethylenes, propylenes and the like. Conventional and typically utilized layer thicknesses of the asbestos-type diaphragm material may be placed on the screen to form the diaphragmic separator element 9. In this connection and as is appreciated by those skilled in the art, too thick an asbestos or the like layer may be dissatisfactorily impermeable and tend to become too readily plugged and inhibiting of free flow through the separator while layers that are too thin may not hold well on the support or even tend to rupture and give intolerably large openings or holes in the layer.

An efficient and satisfactorily practical way of making an asbestos diaphragm separator element 9 is, for example, to draw or aspirate an at least substantially even layer 11 in desired thickness of the asbestos or asbestos-type separator material onto the supporting screen whereupon the diaphragmic deposit is formed in place and integrally held upon and by the support screen 10. This may be done in and by a tank arrangement containing the slurry wherein the screen is held in a most suitable position against the slurry and a suction applied from its back side draws the fibrous diaphragm material onto the screen. The element 9, with or without drying, is then ready for employment in a cell. For this use, the diaphragm separator element 9 is disposed with the screen support 10 portion thereof facing the cathode.

Alternatively, if desired, the asbestos or equivalent diaphragm material in the separator may be in the form of a paper-like web or non-woven mat of the asbestos or other fiber or fiber mixture that is utilized. Such a construction may, as desired, be securely mounted on one or both sides of the electroconductive foraminous support member. Ordinarily, however, a single side application of the separator material is satisfactory. Adhesives, mechanical fasteners or any other desired means may be employed for the mounted diaphragm layer or layers. It is also possible to spray or paint suitable compositions of the asbestos or its equivalent fibrous separator materials on one or both sides of the support member therefor.

As also mentioned, the separator element may advantageously be comprised of an ion-exchange membrane mounted securely on one side only or, if desired, on both sides of the foraminous support member. These are of the well known sort which contain fixed anionic groups that permit intrusion and exchange of cations while excluding anions from an external source. Generally, the resinous membrane or equivalent separator structure has a cross-linked polymer or the like matrix or support construction to or with which are attached or included such negatively charged radicals as: $—SO_3$; $—COO^-$; $—PO_3^{--}$; $—HPO_2^-$; $—AsO_3^{--}$; and $—SeO_3^-$. Vinyl addition polymers and condensation polymers may be utilized for composition of the cation exchange construction, including polymers of such monomers as styrene, divinylbenzene, ethylene and the like aliphatic olefins and monomeric fluorocarbons. Preparation of such resinous materials is described in U.S. Pat. No. 3,282,875. The ion-exchange membranes available under the trade-designation "Nafion" from E. I. duPont de Nemours and Company, Inc., are well suited for the indicated purpose.

An essential part of the separator element 9 of the present invention is the means for electrically connecting the screen support 10 with the cathode 13. One simple and effective way to do this is by means of connecting the lead or tie line 23 (that can also be a conduit, bus bar or cable of the above-identified materials) which is directly connected to the cathode in any suitable way, such as by interwiring the lead to and through power line 22 running between power source 20 and cathode 13. This, as shown, can be done at or near the point where line 22 is connected to the cathode or at any intermediate point along line 22 from and including its connection directly at the negative side of power source 20 from which line 22 emanates. Alternatively, as noted (but with the additional electrical means not specifically shown in the Drawing), a separate power supply connected directly with separator element 9 through screen support 10 may be utilized to maintain the element at about the same voltage potential as that of the cathode. When this is done, the separate power supply is connected through lead 23 and is regulated so as to be at or about the same voltage as that applied to the cathode through conduit 22.

The at least relatively common electrical potential of the separator screen 10 and the cathode 13 achieved by the indicated, effectively shorting connection is the essence and genesis of the present invention. By keeping the depolarized cathode and the support screen of the diaphragm element in shorted relationship at the same or at least substantially the same direct current electrical voltage condition, the bipolar effect is usually at least significantly minimized and, preferably, prevented.

Regardless of the particular means employed for regulating the electrical potentials of the separator element and the cathode, it is most advantageous as has been indicated for them to have and be kept at the same voltage value. This, as is apparent, is literally assured when a direct shorting connection is utilized for the purpose. However, satisfactory results can be realized even when the respective applied voltages on the separator element and the cathode are different so long as they are of values comparatively lower than that on the anode. The voltage differences, if any, that are permissable between separator and cathode are difficult to generalize for all possible applications since suitable ranges may vary between given electrolytic systems. However, the voltage applied on the separator is obviously of some intermediate value between those applied on and across the anode and cathode and should more or less approximate the voltage value of the cathode. In this connection, the separator voltage must be sufficiently negative with respect to anode voltage (taking into account the relative negative potential at which the cathode is operated) to provide effective cathodic protection in the system for the support member of the separator element, especially when the support is metallic while, at the same time, not being so electrically positive with respect to cathode potential as to cause hydrogen formation or evolution at the separator.

Practice of the present invention makes the support screen at least substantially if not completely inactive with respect to the anode and free from objectionable bipolarization tendencies due to the nature of operation of the oxidizing gas depolarized cathode and the electrical potential at which it operates.

A bipolar effect, as it is believed to be encountered, results according to one theory from the energetics involved in electrolytic cell operation when an extra electricity-conducting barrier is independently placed between the anode and cathode therein, such as the support screen in and for separator element 9 when it is not connected to the cathode. The screen then in effect becomes and serves as an extra electrode. In such a situation whenever enough voltage is applied to the cell or electrically induced by the voltage drop involved, the intermediate, electrically disconnected barrier will commence to operate on its anolyte side as a cathode and on its catholyte side as an anode with concurrent flow of ions across the barrier to allow such operation. This, of course, is intolerable. It is the unwanted and highly detrimental effect so nicely minimized or circumvented by practice of the invention.

APPLIED EXEMPLIFICATIONS ILLUSTRATING THE INVENTION

The following Examples illustrate various embodied practices of the invention.

FIRST EXAMPLE

An electrolytic cell similar to that shown in FIG. 1 with an anode of titanium coated with an oxide of ruthenium and titanium spaced apart from an oxygen gas depolarized cathode by a du Pont "Nafion 12V6C1" cation exchange membrane is operated to produce chlorine gas at the anode and sodium hydroxide in the cathode compartment. The ion exchange membrane is mounted on a 100 mesh nickel screen and placed between anode and cathode in the cell so as to have the screen facing the cathode. Each electrode has a surface area of 3 square inches (ca. 19.35 square centimeters) and the screen has about the same flat size. The cathode is formed by admixing 7 grams of carbon black with 0.2 grams of carbon fiber, 3.3 milliliters of du Pont Teflon 30B latex and about 20 to 30 milliliters of water to form a dough-like mixture. The mixture is rolled to about 0.05 inches thick and then pressed together with a 40 mesh woven silver screen using a force of about 15 tons. The pressed composite is heated in a nitrogen atmosphere for about 2 to 3 minutes at a temperature of about 350° to 360° C. After cooling in a nitrogen atmosphere, the composite is heated to about 100° to 120° C. and sprayed on a single surface with sufficient "Teflon 30B" latex (diluted one part latex to eight parts water) to form a coating of about 2 to 10 milligrams Teflon latex per square centimeter of surface. The sprayed composite is then heated for about 2 minutes at about 350° to 360° C. in a nitrogen atmosphere. The sprayed Teflon latex surface is positioned in the cell to form a wall portion of a depolarizing gas compartment.

In its installation in the cell, the nickel screen is electrically connected directly to the cathode by means of a copper wire lead.

With a low direct current voltage applied across the anode and cathode, and aqueous sodium chloride brine is circulated through the anode compartment, with sodium chloride additions for composition control, and a sodium hydroxide containing catholyte is circulated, with water additions for composition control. Oxygen gas is pumped through the gas compartment at a rate of 66 milliliters per minute after first saturating the oxygen with water. During operation, the anolyte has an acidity (pH) of 5.5 and contains about 260 to 290 grams per liter of sodium chloride. The catholyte contains 79.6 grams per liter of sodium hydroxide and 4.1 grams per liter of sodium chloride. The electrolyte temperature is about 70° C. Operating voltage is 1.901 and the amperage is 1.5.

Cell operation is satisfactory without production of either hydrogen gas in the cathode compartment or observable bipolarization of the separation element during the operation or noticeable corrosion of the screen after prolonged running of the cell.

SECOND EXAMPLE

In another specific illustration of the invention, an asbestos slurry is drawn to make a deposited layer of about 1/16 inch (ca. 0.16 centimeters) on a 100 mesh nickel screen to form a diaphragm element in accordance with the present invention and in the style shown with more detail in FIG. 2. A 3 square inch section of the support diaphragm is employed with excellent and entirely satisfactory results for the successful electrolysis of sodium chloride brine in a cell apparatus constituted and run as above shown and described in connection with the First Example.

After 45 days of continuous operation, the cell is shut down and the diaphragm element removed for inspection. The asbestos diaphragm is stripped off the screen for purposes of screen examination and testing. There is no detectible weight loss in the screen and no discernible signs of corrosion thereon.

The same procedure is repeated excepting to employ a stainless steel screen to support the asbestos diaphragm. The same good results are obtained.

In contrast and to illustrate practice not in accordance with the invention, when the foregoing is duplicated with a stainless steel screen support excepting to disconnect the wire shorting the screen to the cathode, a substantial formation of iron hydroxide flock is visually discernible in the catholyte after only about 10 days of operation which becomes noticeably heavier after 20 days. This is accompanied within the indicated periods by substantial and readily measurable weight loss of the screen due to corrosion because of operation thereof in a bipolarized condition in the cell.

Analogous good results are obtained when the foregoing Second Example is repeated excepting to replace the deposited asbestos layer with an attached "Nafion" membrane section on the nickel screen. The same occurs when repetitions of the procedures are repeated with varied cell operating voltages and changed salt and/or caustic concentrations in anolyte and catholyte.

Many changes and modifications can readily be made and provided in various adaptations and embodiments in accordance with the present invention without substantially departing from the apparent and intended spirit and scope of same relevant to the instantly contemplated electrolytic cell separator support development and provision. Accordingly, the invention and all in pursuance and accordance with same is to be taken and liberally construed as it is set forth and defined in the hereto-appended Claims.

What is claimed is:

1. An improved method of operating an electrolytic cell wherein there is:

an oxidizable material in aqueous dispersion is fed to an anolyte compartment in which there is an electrically charged oxidizing anode producing one product of the electrolysis plus positively charged cations in the anolyte;

a reducible catholyte is maintained in a catholyte compartment in which there is a catalytically active oxygen gas-bearing depolarized reducing cathode that is charged electrically at a lower electric potential than that of the anode producing negatively charged anions in the catholyte for another product of the electrolysis; and an electrically conductive separator element separating anolyte from catholyte is spaced between the anode and the depolarized cathode and thereby functions to pass cations from the anolyte to the catholyte wherein said cations combine with said anions to produce said catholyte product; while an appropriate direct current electrical potential is imposed between and across said anode and said cathode so that the anode is electrically more positive than the cathode thereby causing and maintaining the electrolysis of the electrolytic reactions in said anolyte and said catholyte;

wherein the improvement comprises constructing said separator element from materials whereby it is less catalytically active than the cathode and; electrically connecting said separator element and said depolarizing cathode so as to maintain them during electrolysis at about the same electrical potential to render said separator element at least substantially non-bipolarizable.

2. Operating the improved method of claim 1 by feeding an aqueous solution of an alkali metal halide as the anolyte to and for the cell so as to produce a halogen at the anode and an alkali metal hydroxide at the cathode.

3. Operating the improved method of claim 2 by feeding sodium chloride brine as anolyte to and for the cell so as to produce chlorine at the anode and sodium hydroxide at the cathode.

4. Operating the improved method of claim 1 by directly connecting said separator element to and with said depolarizing cathode in an electrically shorting manner so as to maintain them at the same electrical potential.

5. Operating the improved method of claim 1 by feeding an aqueous solution of a halogen acid as the anolyte to and for the cell so as to produce a halogen at the anode.

6. An improved electrolytic cell which comprises:

(a) an anode compartment adapted to contain an anolyte;

(b) an anode positioned in said anode compartment;

(c) a cathode compartment adapted to contain a catholyte;

(d) a catalytically active, oxygen-bearing gas depolarized cathode in said cathode compartment;

(e) a separator element which is spaced away from and intermediately located in said cell between both said anode and said cathode, said anode compartment and said cathode compartment being juxtaposed and separated in said cell, wherein said separator element comprises a suitable separator material placed on at least one side of an electroconductive foraminous support member;

(f) a source of and means for providing electrical current power connected to both said anode and said cathode so that the anode is electrically more positive than the cathode;

wherein the improvement comprises:

constructing said separator element from materials whereby it is less catalytically active than the cathode and; providing an electrical means for maintaining said electroconductive foraminous support element at about the same applied electrical voltage potential as that of said cathode.

7. An improved electrolytic cell in accordance with the cell of claim 1 wherein said separator elements consists essentially of two sides; one side being the suitable separator material section; the other side being the foraminous support member; wherein said separator element is located in said cell so as to have the electroconductive support member side of the element facing said depolarized cathode.

8. An improved electrolytic cell in accordance with the cell of claim 7, wherein said electroconductive foraminous support member is metallic.

9. An improved electrolytic cell in accordance with the cell of claim 6, wherein said electrical means for maintaining the voltage applied to said electroconductive foraminous support element is a separate power supply thereto connected that is adapted to maintain the element at about the same voltage potential as that of said cathode.

10. An improved electrolytic cell pursuant to that of claim 9, in which said separator material is asbestos.

11. An improved electrolytic cell in accordance with the cell of claim 6, wherein said electrical means for maintaining the voltage applied to said electroconductive foraminous support member is a direct shorting electrical connection between said separator element and said depolarized cathode so as to maintain them at the same electrical potential during operation of said cell.

12. An improved electrolytic cell in accordance with the cell of claim 11, wherein said electroconductive foraminous support member is metallic.

13. An improved electrolytic cell in accordance with the cell of claim 6, wherein said foraminous metallic grid support member is comprised of a woven metallic screen which is resistant to corrosion and catholyte attack at least during cell operation.

14. An improved electrolytic cell pursuant to that of claim 13, in which said screen is comprised of at least a nickel component.

15. An improved electrolytic cell pursuant to that of claim 13, in which said screen is nickel.

16. An improved electrolytic cell in accordance with the cell of claim 6, wherein said electroconductive foraminous support member is metallic.

17. An improved electrolytic cell in accordance with the cell of claim 6, wherein said cathode comprises an assembly in which there is a porous, gas-transmitting wall section therein, one face of which is adapted to be in contact with the catholyte and the opposite face of which is simultaneously adapted to be in contact with an oxidizing gas.

18. An improved electrolytic cell in accordance with the cell of claim 6, wherein the separator material in said separator element is in a diaphragm form comprised of asbestos.

19. An improved electrolytic cell in accordance with the cell of claim 6, wherein the separator material in said separator element is in a diaphragm form comprised of an ion-exchange membrane.

* * * * *